United States Patent [19]

Jackson

[11] Patent Number: 4,556,005

[45] Date of Patent: Dec. 3, 1985

[54] BOAT WITH AUXILIARY STEERING APPARATUS

[76] Inventor: Gregg B. Jackson, 721 Upshur St. NW., Washington, D.C. 20011

[21] Appl. No.: 675,611

[22] Filed: Nov. 28, 1984

[51] Int. Cl.[4] ..... B63H 25/00

[52] U.S. Cl. ..... 114/146; 114/152

[58] Field of Search ..... 114/61, 39, 121–129, 114/152, 271, 274, 162, 144 R, 146, 280, 281

[56] References Cited

U.S. PATENT DOCUMENTS

| | | | |
|---|---|---|---|
| 2,972,322 | 2/1961 | Parker | 114/126 |
| 2,998,791 | 9/1961 | Light | 114/126 |
| 3,249,081 | 5/1966 | Schuster | 114/152 |
| 3,911,845 | 10/1975 | Holtom | 114/39 |
| 4,261,278 | 4/1981 | Gaudin | 114/126 |
| 4,381,725 | 5/1983 | Rowan | 114/126 |

FOREIGN PATENT DOCUMENTS

| | | | |
|---|---|---|---|
| 84995 | 8/1983 | European Pat. Off. | 114/39.1 |
| 881453 | 7/1949 | Fed. Rep. of Germany | 114/126 |
| 1464779 | 1/1967 | France | 114/39.1 |
| 2033308 | 5/1980 | United Kingdom | 114/39.1 |

*Primary Examiner*—Trygve M. Blix
*Assistant Examiner*—Stephen P. Avila

[57] ABSTRACT

An apparatus for aiding in the steerage of boats has one or more fins connected to each side of the aft part of the boat, such that the fins are entirely above the water until the boat is so heeled as to have moderate helm, and after that the fin(s) on the heeled-down side become progressively more immersed as the boat heels further. The spanwise axes of the fins are about vertically disposed when the boat is upright. The cordwise axes of the fins slope inward toward the longitudinal axis of the boat. The fore-aft sectional shape of the fins may be asymmetrical to improve the lift/drag characteristics. One fin on either side may be attached spanwise to a shaft mounted in a shaft housing extending obliquely through the hull and deck; the shafts may be fixed at several angles, or actively adjusted to counter variations in the magnitude of weather-helm and lee-helm experienced by the boat.

16 Claims, 8 Drawing Figures

BOAT WITH AUXILIARY STEERING APPARATUS

BACKGROUND OF THE INVENTION

The present invention relates to boats and ships, and more particularly, to boats with auxiliary apparatus for aiding in their steerage.

As a sailboat under way heels to leeward it usually develops weather-helm. Weather-helm is a torque about the vertical axis of the boat that forces the bow to windward unless a counter force is applied by the rudder or other means, Weather-helm is caused by the asymmetrical shape of the heeled hull making way through the water, and by the center of effort on the sails moving outboard of the boat's longitudinal axis as the masts lean with the heeling boat. The magnitude of weather-helm in a given boat generally increases as the boat heels further to leeward.

When sailboats head downwind in heavy weather, they often roll, heeling to windward as well as to leeward. When heeled acutely to windward, the boats often develop substantial lee-helm, which is a torque on the boat in the opposite direction of weather-helm. If this force is not countered quickly, it will induce a dangerous uncontrolled jibe.

Small amounts of weather-helm and lee-helm (hereafter generically referred to as "helm") are seldom a serious problem. But during the severe heeling that is common in heavy weather, many boats develop dysfunctional amounts of helm. Steerage with the boat's rudder is the immediate means used to counter the helm. But as the heel of the boat increases, the rudder becomes less effective in countering the helm because the rudder axis angles obliquely to the water surface and the resulting force on the rudder is divided between a lateral component that corrects the helm and a vertical component that is useless for that purpose. In addition, under extreme angles of heel, part of the rudder often projects out of the water.

Substantial helm slows the boat because of the drag on the acutely turned rudder. It also puts high stress on the rudder and steering means, and strains the helmsperson. Occasionally the helm becomes so strong that it overpowers the rudder and swings the boat out of control.

Several methods are used to reduce extreme helm. One method of reducing weather-helm is to move the sail plan farther forward, or to move the center of lateral resistance of the hull farther aft. If the boat is already well-designed, this will create a lee-helm in light winds which adversely affects the speed and handling of the boat in those conditions. A hull can be configured during the design stage so that it does not develop asymmetrical hydrodynamic forces when heeled. But this usually compromises other design objectives, and it does not eliminate the helm caused by the center of effort on the sails moving outboard as the boat heels. A third approach is to put a trim tab on the aft edge of the keel and rotate it to counter the helm. This approach is expensive, and it requires a complex mechanical linkage to the boat's main steering system to be of use when the boat is heading downwind and rolling substantially. A few boats have been fitted with retractable boards protruding out of the aft edge of the keel or the aft underbody of the hull, increasing the lateral resistance in the aft part of the boat. This solution is also expensive, prone to operating malfunctions, and does not counter the lee-helm caused when rolled to windward. Well-handled boats reduce sail in heavy winds to reduce the heeling, but modest wind velocity changes are frequent at sea and reefing the sails usually requires considerable effort on the part of the crew. A few boats have used dual rudders transversely mounted, or a pendulum rudder that swings to the heeled-down side. Both have real advantages in countering helm, but both are expensive and heavy, and the former adds drag in light winds.

Powerboats, particularly low-speed ones, encounter some steerage difficulties as they heel. The difficulty is seldom as severe as with sailboats. Because the heeling is usually in the form of rolling from one side to the other and because powerboats are not subject to the dangers of an uncontrolled jibe, powerboat helsmpeople usually don't correct with the rudder. Instead, they allow the boat to zigzag back and forth across the intended course. This causes an increase in fuel consumption and in travel time.

SUMMARY OF THE INVENTION

The present invention is a boat with an apparatus to aid in its steerage by countering some of the helm experienced when heeling. The steering aid apparatus operates without creating any hydrodynamic drag when the boat is upright. The amount of corrective torque that it generates increases with the extent of heeling, just as the helm usually does. Some of the preferred embodiments are relatively inexpensive, mechanically simple, and not prone to malfunctions. It can instantly function when needed, in a totally passive manner witout any attention from the crew. In rough weather conditions it reduces the stress on the boat's rudder, the main steering mechanism, the helmsperson, and also on any autopilot, self-steering vane, or similar device that might be in use. It also provides more turning torque for a given amount of drag than is possible with a conventional rudder, and thus it slows the speed of the boat less than would correction with the rudder alone.

DESCRIPTION OF THE PREFERRED EMBODIMENTS

Figure 1:
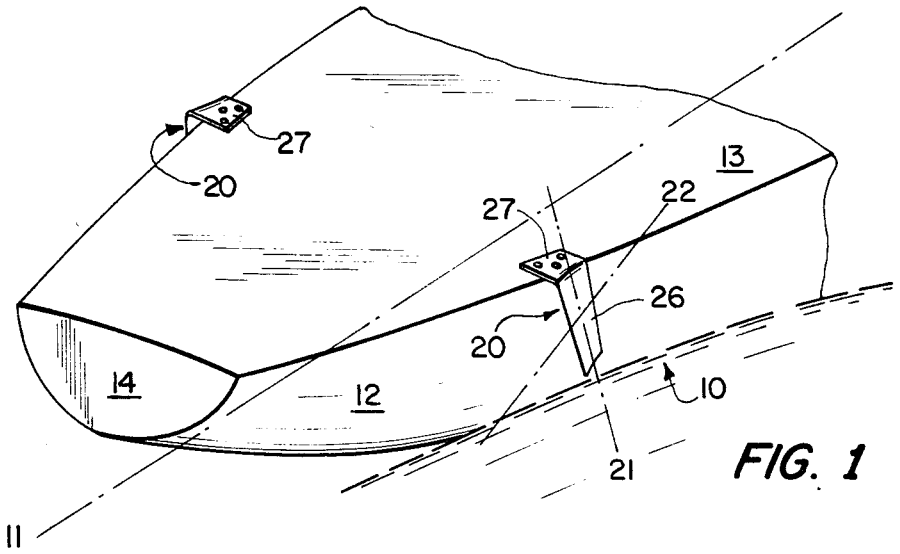
FIG. 1 is a perspective view of the aft part of a boat with a preferred embodiment of the present invention.
Figure 2:
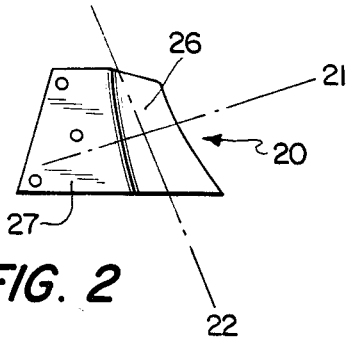
FIG. 2 is an enlarged plan view of the fin of FIG. 1.
Figure 4:
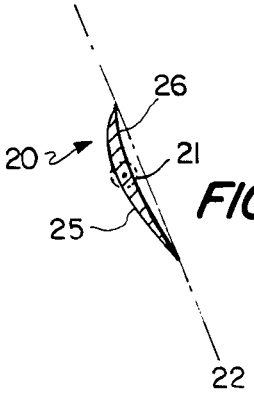
FIG. 4 is a cross-sectional view of the fin in FIG. 2 taken along line 4—4.
Figure 3:
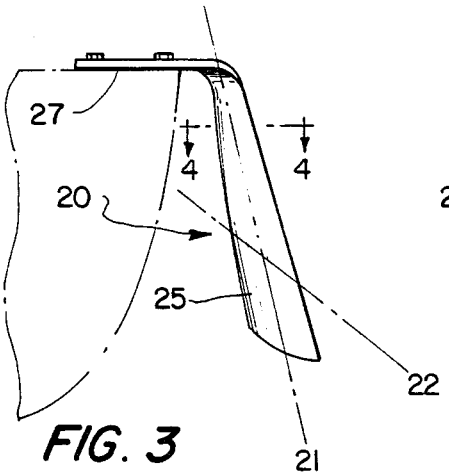
FIG. 3 is an enlarged aft elevation view of the fin of FIG. 1.

A preferred embodiment of the present invention, a boat with an auxiliary steering apparatus, is shown in FIGS. 1, 2, 3, and 4. The boat 10 is of the water-borne type. It has a longitudinal axis 11. One fin 20 is connected to each side of the aft third of the boat 10. The fins 20 have spanwise axes 21 with a generally vertical disposition when the boat 10 is upright. They are preferably inclined outboard from vertical at an angle of about ten to twenty degrees, as they project downward. The fins 20 have cordwise axes 22 that incline inward toward the longitudinal axis 11 at an angle of about twenty to thirty degrees, as they project forward. The fins 20 have spans equal in length to about ten to twenty percent of the maximum beam of the boat 10 and have cords of about half the length of the spans. The fins 20 have fore-aft sectional shapes wherein the inboard surface 25 is disposed farther from the cordwise axis 22 than is the outboard surface 26, thereby increasing the transverse hydrodynamic force directed toward the boat 10 by the fin 20 when it is immersed. The cords at the bottoms of the fins 20 preferably incline inward toward the longitudinal axis 11 as they project forward at about a five degrees more acute angle than do the cords at the top of the fins 20. This compensates for the torsional distortion about the spanwise axis 21 that occurs when the fins 10 are immersed while under way.

Each fin 20 is connected to the boat 10 with a single flange 27, extending from near the upper extremity of the fin 20, inboard about horizontally when the boat is upright, and affixed to the deck 13 of the boat 10. The fin 20 is mounted so that at least part of it, the upper extremity, is close to the boat—at not more than a distance equal to twenty percent of the boat's 10 maximum beam. The fins 20 are vulnerable to damage when approaching and leaving a dock. The single flange 27 mounting to the deck allows easy attachment and removal in the relatively calm water of a harbor or channel.

Figure 5:
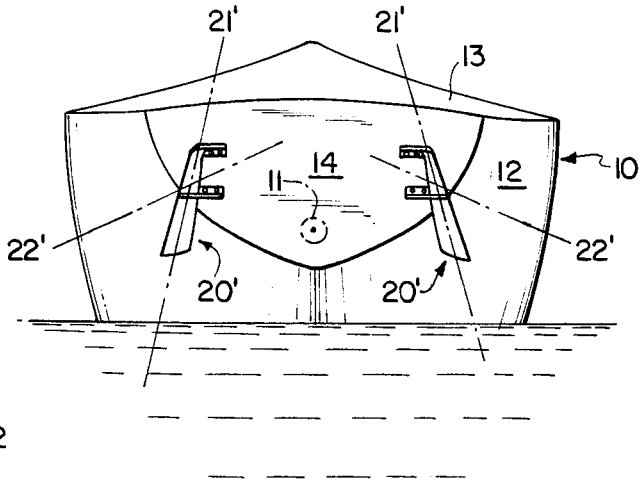
FIG. 5 is an aft elevation view of a boat with another exemplary embodiment of the present invention, having the fins mounted on the stern transom of the boat.

Several other exemplary embodiments of the present invention are possible. Transom fins 20' can be mounted on each side of the stern transom 14 of the boat 10 so that when the boat 10 is upright, they do not extend beyond the most outboard extremity of the transom, as is shown in FIG. 5. This position allows the fins 20' to be protected from damage during docking maneuvers without being removed. The transom fins 20' have spanwise axes 21' inclined outboard from vertical at an angle of about ten to twenty degrees as they project downward, and cordwise axes 22' that incline inward toward the longitudinal axis 11 at an angle of about twenty to thirty degrees, as they project forward.

Figure 6:
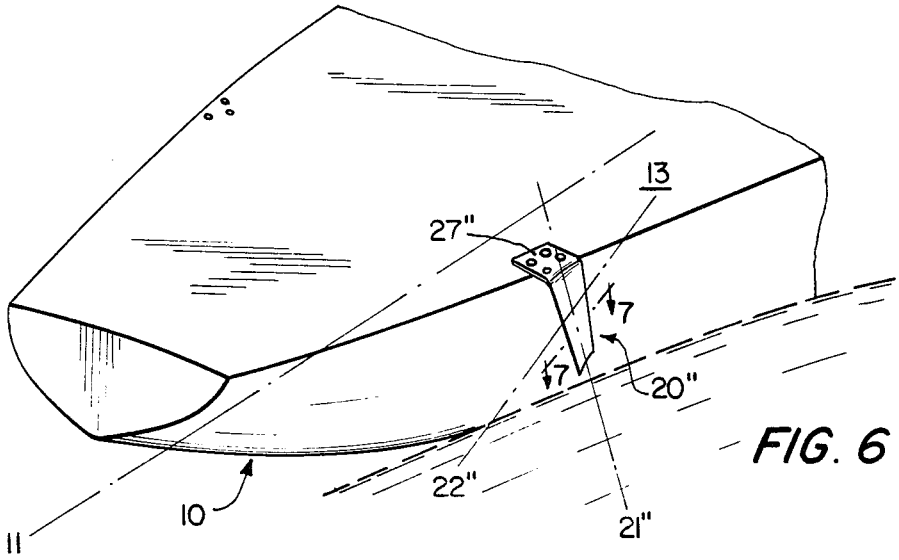
FIG. 6 is a perspective view of the aft part of a boat with another exemplary embodiment of the present invention, having a single fin removably mounted to one side of the boat and suitable for mounting on either side of the boat.
Figure 7:
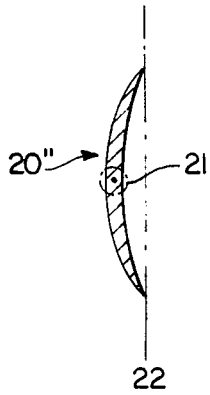
FIG. 7 is a enlarged cross-sectional view of the fin of FIG. 6, taken along line 7—7.

FIG. 6 shows an embodiment that utilizes a reversible fin 20'' removably mounted to one side of the boat 10. The reversible fin 20'' has a symmetrical flange 27'' that is somewhat larger than the flange 27 shown for the embodiment of FIG. 1. The symmetrical flange 27'' extends inboard the same distance from both vertical edges of the reversible fin 20'', such that it can mount the reversible fin 20'' to the deck 13 on either side of the boat 10 with the cordwise axis 22'' substantially inclined inward toward the longitudinal axis 11 of the boat 10 and with the spanwise axis 21'' inclined moderately outboard of vertical. The reversible fin 20'' has a fore-aft sectional shape that is symmetrical longitdinally, such as shown in FIG. 7, so that it will function well with either vertical edge in the forward position. The reversible fin 20'' can be mounted to whichever side of the boat 10 is expected to be usually the heeled down side for a given period of sailing. Or when running downwind, it can be mounted to the windward side to help prevent accidental jibes induced by lee-helm when the boat 10 is rolled to windward.

Figure 8:
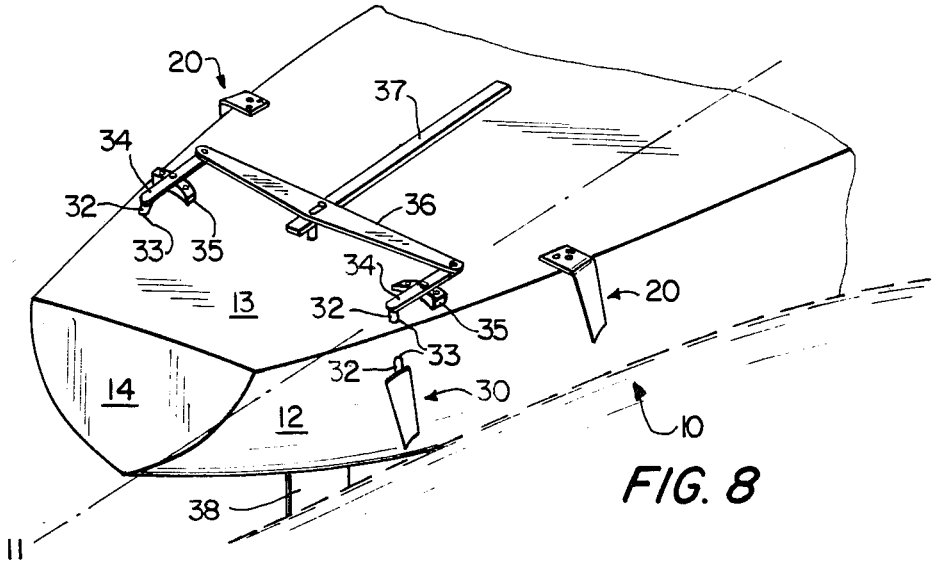
FIG. 8 is a perspective view of the aft part of a boat with another exemplary embodiment of the present invention, having two fins on each side of the boat, with one on each side being mounted with a shaft in a shaft housing and linked to the main steering mechanism.

FIG. 8 shows another exemplary embodiment of the present invention. There is a plurality of fins on each side of the boat 10, in this case rotatable fin 30 and fin 20. Fin 20 is mounted farther above the water than rotatable fin 30 so that as the boat progressively heels, first rotatable fin 30 will become immersed and then fin 20 will become immersed. Fin 20 is just as shown in FIGS. 1, 2, 3, and 4 but for this embodiment is relatively smaller in size. Rotatable fin 30 is about the same size and shape of fin 20 but is mounted spanwise on a shaft 32 that is inserted through a shaft housing 33 extending obliquely through the hull 12 and deck 13 of the boat 10. The shaft 32 extends several inches below the shaft housing 33 before rotatable fin 30 is affixed to it. A fin tiller 34 connects to the shaft 32 and is used to adjust the angle of the rotatable fin 30. There is a means for fixing the rotatable fin 30 at different angles; in this case it is a positioning plate 35. There is also a linking means, in this case a link strut 36, connected between the fin tiller 34 and the main steering mechanism, which in this case is a main tiller 37 for the boat's 10 rudder 38. As the main tiller 37 is moved to adjust the rudder 38, the rotatable fins 30 on the shafts 32 will be adjusted in the same direction. When the crew do not desire the rotatable fins 30 to be activated in concert with the rudder 38, the link strut 36 is disconnected and the fin tillers 34 are fixed at a given angle with the positioning plate 35.

The present invention works as follows. When a boat is under way and not heeled much, the fins are entirely out of the water. Under these conditions, boats seldom have troublesome helm. When the boat heels to the point at which it does develop undesired helm, the fin(s) on the side of the boat that is heeled down become partially immersed. The partially immersed fin(s) create a hydrodynamic force that torques the boat about its vertical axis in a direction that alleviates the helm. As the boat heels further, the fin(s) become immersed over more of their span(s), creating additional hydrodynamic force in the same direction.

When immersed, the fins of the present invention work like a conventional rudder with two major differences. First, they can operate in a passive manner, applying predetermined forces at various angles of heel, without any attention from the crew or energy expenditure by an autopilot steering mechanism. Second, because of their shape and positioning, they can provide more torque on a boat for a given amount of drag than can a conventional rudder, and thus they will correct the helm with less reduction in the boat's speed than is possible with a conventional rudder.

The relative efficiency of the fins is due to several factors. Unlike conventional rudders, the spanwise axes of the fins can be set so that they are approximately vertical when the boat is heeled and the fin(s) are immersed. This allows the hydrodynamic lift on the fin to be about in the horizontal plane and thus most efficient for countering the helm. When a conventional rudder on a heeled boat is applied to correct helm, the lift on the rudder blade has a vertical component which does not aid in correcting the helm. When immersed, the fin(s) are outboard of the longitudinal axis of the boat on the heeled down side and thus their hydrodynamic drag, as well as their lift, serves to torque the boat in the desired direction. As a boat heels, a conventional rudder becomes somewhat outboard of the longitudinal axis of the boat, but outboard on the high side, and thus its drag—but not its lift—actually torques the boat in the same direction as the helm does. In addition, the fins on each side of a boat need to turn the boat in only one direction, whereas a rudder needs to turn the boat in both directions. This allows the fins' cross-sectional shape to be transversely asymmetrical and provide more lift for a given amount of drag than can a symmetrically shaped rudder blade.

The size, shape, and positioning of the fins is important to the effective functioning of the present invention. They must be selected and coordinated for each boat. The amount of helm that a boat experiences at a given angle of heel varies from boat to boat, depending on the size and shape of the hull and sail plan. Most well-designed boats will not develop much helm until heeled about eight to twelve degrees, so the fins generally should not start to immerse until the boat is heeled that much. The rate of increase in the helm with an additional amount of heeling also varies from boat to boat. The fin(s) should not generate so much force that they fully eliminate the weather-helm at any angle of heel. Slight weather-helm is beneficial, and in heavy winds lee-helm can be hazardous.

The vertical disposition of the fins and their span lengths will be the main determinants of the angle of heel at which the auxiliary steering apparatus begins to counter the heel-induced helm. The fin's longitudinal disposition on the boat, the incline of the cordwise axes, the cord lengths, and the fore-aft sectional shapes will be the main determinants of how much corrective torque is generated for each inch of immersed fin.

It is to be understood that various changes can be made in the form, construction, and arrangement of parts of the apparatus described hereinabove without departing from the spirit and scope of the invention or sacrificing all its material advantages, the description being merely preferred or exemplary embodiments thereof.

I claim:

1. In a water-borne boat having a longitudinal axis, an auxiliary steering device, comprising:
- at least one fin connected to the aft half of said boat transversely from said longitudinal axis;
- said fin having a cordwise axis that angles inward toward said longitudinal axis as said cordwise axis projects forward;
- said fin having a spanwise axis with a generally vertical disposition when said boat is upright;
- said fin being disposed so that at least part of it is close to said boat and all of it is out of the water when said boat is upright in a flat sea; and
- said fin being sized, shaped, and positioned so that said fin is generally out of the water until said boat is so heeled as to have an undesired amount of helm, and after that, said fin, when connected to the heeled-down side of said boat, becomes progressively more immersed with further heeling of said boat, until fully immersed, relieving part but not all of the helm experienced by said boat when heeled down on that side.

2. The device as recited in claim 1, wherein:
- said fin has a fore-aft sectional shape that is symmetrical;
- said fin has a flange connected near its upper extremity, extending inboard about horizontally when said boat is not heeled and about an equal distance from the forward and aft edge of said fin;
- such that a single said fin can be mounted on either side of said boat with its said cordwise axis angled inward toward said longitudinal axis of said boat.

3. In a water-borne boat having a longitudinal axis, an auxiliary steering apparatus, comprising:
- at least one fin connected to each side of the aft third of said boat;
- said fins having cordwise axes that substantially angle inward toward said longitudinal axis as they project forward;
- said fins having spanwise axes a generally vertical disposition when said boat is upright;
- said fins being disposed so that at least part of each is close to said boat and all of each is out of the water when said boat is upright in a flat sea; and
- said fins being sized, shaped, and positioned so that said fins are generally out of the water until said boat is so heeled as to have moderate helm, and after that, said fin(s) on the heeled-down side of said boat become progressively more immersed with further heeling of said boat, until fully immersed, relieving part but not all of the helm experienced by said boat.

4. The apparatus as recited in claim 3, wherein said spanwise axes of said fins incline outboard from vertical, when said boat is upright, at an angle of about ten to twenty degrees as they project downward, and said cordwise axes incline inward at an angle of about fifteen to forty degrees to said longitudinal axis.

5. The apparatus as recited in claim 3, wherein said fins have spans of about ten to twenty percent of the maximum beam of the boat, and have cords of about one-half to one-fourth the length of the spans.

6. The apparatus as recited in claim 3, wherein said fins have inboard and outboard surfaces, and fore-aft sectional shapes with said inboard surfaces disposed farther said cordwise axes over most of their lengths than said outboard surfaces.

7. The apparatus as recited in claim 3, wherein the cords at the bottom of said fins incline inward toward said longitudinal axis of said boat at a few degrees more acute angle than do the cords at the top of said fins.

8. The apparatus as recited in claim 3, further comprising flanges connected near the upper extremities of said fins, and wherein said boat has a deck, said flanges extend inboard about horizontally when said boat is upright, and said flanges are rigidly affixed to said deck.

9. The apparatus as recited in claim 3, wherein a plurality of said fins are connected to each side of said boat, disposed at different distances above the water, such that as said boat progressively heels, an increasing number of said fins on the heeled-down side of said boat will become immersed in the water.

10. The apparatus as recited in claim 3, wherein said fins are positioned so that, when said boat is upright, they do not extend beyond the most outboard extremity of the transverse section at which they are connected to said boat.

11. The apparatus as recited in claim 3, wherein said boat has a stern transom, and said fins are connected to said stern transom.

12. The apparatus as recited in claim 3, wherein said boat has a hull and deck, and further comprising:
- shafts attached spanwise to one said fin on each side of said boat;
- shaft housings extending obliquely through said hull and said deck on each side of said boat, with said shafts inserted through said shaft housings;

means for rotating said fins attached to said shafts; and means for fixing said fins at different angles or rotation.

13. The apparatus as recited in claim 12, further comprising:

a rudder for said boat;

a main steering mechanism to activate said rudder; and a linking means connected between said means for rotating said fins and said main steering mechanism;

so that as said main steering mechanism is moved to rotate said rudder, said fins will be rotated in the same direction as said rudder.

14. In a water-borne boat having a longitudinal axis, an auxiliary steering apparatus, comprising:

at least one fin connected to each side of the aft third of said boat;

said fins having spans of about ten to twenty percent of the maximum beam of said boat and having cords of about one-half to one-fourth the length of the spans;

said fins having cordwise axes that incline inward toward said longitudinal axis of said boat at an angle of about fifteen to forty degrees as they project forward;

said fins having spanwise axes that incline outboard from vertical, when said boat is upright, at an angle of about ten to twenty degrees as they project downward;

said fins being disposed so that at least part of each is close to said boat and all of each is out of the water when said boat is upright in flat seas; and said fins being sized, shaped, and positioned so that said fins are generally out of the water until said boat is so heeled as to have moderate helm, and after that, said fin(s) on the heeled-down side of said boat become progressively more immersed with further heeling of said boat, until fully immersed, relieving part but not all of the helm experienced by said boat.

15. The apparatus as recited in claim 14, wherein said fins have inboard and outboard surfaces, and fore-aft sectional shapes with said inboard surfaces disposed farther from said cords, over most of their length, than said outboard surfaces.

16. The apparatus as recited in claim 14, further comprising flanges connected near the upper extremities of said fins, and wherein said boat has a deck, said flanges extend inboard about horizontally when said boat is upright, and said flanges are rigidly affixed to said deck.

* * * * *